US006969274B2

(12) United States Patent
Kudo et al.

(10) Patent No.: US 6,969,274 B2
(45) Date of Patent: Nov. 29, 2005

(54) CONNECTOR SMALL IN SIZE AND SIMPLE IN STRUCTURE

(75) Inventors: Takaaki Kudo, Tokyo (JP); Daisuke Machihara, Saitama (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/899,409

(22) Filed: Jul. 26, 2004

(65) Prior Publication Data

US 2005/0026494 A1 Feb. 3, 2005

(30) Foreign Application Priority Data

Jul. 30, 2003 (JP) ..... 2003-282370
Jul. 16, 2004 (JP) ..... 2004-210475

(51) Int. Cl.[7] ..... H01R 12/24

(52) U.S. Cl. ..... 439/495; 439/67

(58) Field of Search ..... 439/495, 496–499, 439/67, 77

(56) References Cited

U.S. PATENT DOCUMENTS 3,999,826 A * 12/1976 Yurtin ..... 439/495
4,679,868 A * 7/1987 Hasircoglu ..... 439/495
4,900,268 A * 2/1990 Kunishi ..... 439/493
5,779,498 A * 7/1998 Asakawa ..... 439/495
6,482,027 B2 * 11/2002 Ishii et al. ..... 439/495
6,811,431 B2 * 11/2004 Hsieh ..... 439/495

FOREIGN PATENT DOCUMENTS

JP 7153531 6/1995

* cited by examiner

*Primary Examiner*—Hien Vu
(74) *Attorney, Agent, or Firm*—Collard & Roe, P.C.

(57) ABSTRACT

A connector is for connecting a connection object which has a wiring portion, a protruding portion protruding from the wiring portion on one side thereof, and a wiring pattern extending from the wiring portion to the protruding portion. In the connector, a housing has a main body portion provided with a receiving surface for receiving the wiring portion. The housing further has a side portion disposed at one side of the main body portion. The side portion has a receiving groove for receiving the protruding portion. A contact is held by the side portion so as to be connected to said wiring pattern of the protruding portion.

29 Claims, 5 Drawing Sheets

CONNECTOR SMALL IN SIZE AND SIMPLE IN STRUCTURE

CROSS REFERENCE TO RELATED APPLICATIONS

This application claims priority to prior Japanese application Nos. JP 2003-282370, filed Jul. 30, 2003 and JP 2004-210475, filed Jul. 16, 2004, the disclosure of which is incorporated herein by reference.

BACKGROUND OF THE INVENTION

This invention relates to a connector for use in connection of a connection object, such as a flexible board.

For example, Japanese Patent Application Publication (JP-A) No. H7-153531 discloses a connector for connecting a flat cable as a connection object.

Referring to FIG. 1, the connector disclosed in the above-mentioned publication will be described. The connector depicted at 41 has a U-shaped housing. The housing 42 is provided with a pair of tail plates 43 formed at opposite sides of an end portion thereof. The housing 42 has a bottom portion 42*c* provided with a plurality of contact receiving grooves 42*c*1. In the contact receiving grooves 42*c*1, a plurality of contacts 46 are received and held, respectively. Each contact 46 has a front end provided with a contacting portion 46*a* to be contacted with a corresponding one of a plurality of contacting patterns 54 of a flat cable 51, and a rear end provided with an engaging portion 46*b*. The engaging portion 46*b* is inserted into a through hole 42*a*1 formed at a base portion 42*a* of the housing 42.

The connector 41 has a recessed portion 44 formed between the base portion 42*a* of the housing 42 and the tail plates 43 and defined by left and right side portions 42*b* and the bottom portion 42*c* of the housing 42.

The flat cable 51 has one end provided with a connection base portion 52 of a rectangular shape. The connection base portion 52 has a rear end connected to an extending portion 53 narrower in width than the connection base portion 52. The connection base portion 52 has an upper surface provided with the contacting patterns 54. The extending portion 53 has an upper surface provided with a plurality of wiring patterns 55. The contacting patterns 54 are connected to the wiring patterns 55, respectively. The connection base portion 52 has a lower surface to which a reinforcing plate 56 is fixedly attached.

The flat cable 51 and the connector 41 are connected to each other in the following manner. The flat cable 51 is turned upside down from a position illustrated in FIG. 1. The connection base portion 52 is inserted into the recessed portion 44 of the connector 41. Then, the contacting patterns 54 are contacted with the contacting portions 46*a* of the contacts 46.

In the above-mentioned connector 41, the housing 42 has the base portion 42*a* and the left and the right side portions 42*b*. Therefore, the connector 41 is complicated in structure and is inevitably increased in overall size.

SUMMARY OF THE INVENTION

It is therefore an object of the present invention to provide a connector small in size and simple in structure.

Other objects of the present invention will become clear as the description proceeds.

According to an aspect of the present invention, there is provided a connector for connecting a connection object which has a wiring portion, a first protruding portion protruding from the wiring portion on one side thereof, and a wiring pattern extending from the wiring portion to the first protruding portion. The connector comprises a housing and a first contact held by the housing, the housing having a main body portion provided with a receiving surface for receiving the wiring portion and a first side portion disposed at one side of the main body portion, the first side portion having a first receiving groove for receiving the first protruding portion, the first contact being held by the first side portion so as to be connected to the wiring pattern of the first protruding portion.

DESCRIPTION OF THE PREFERRED EMBODIMENTS

Figure 1:
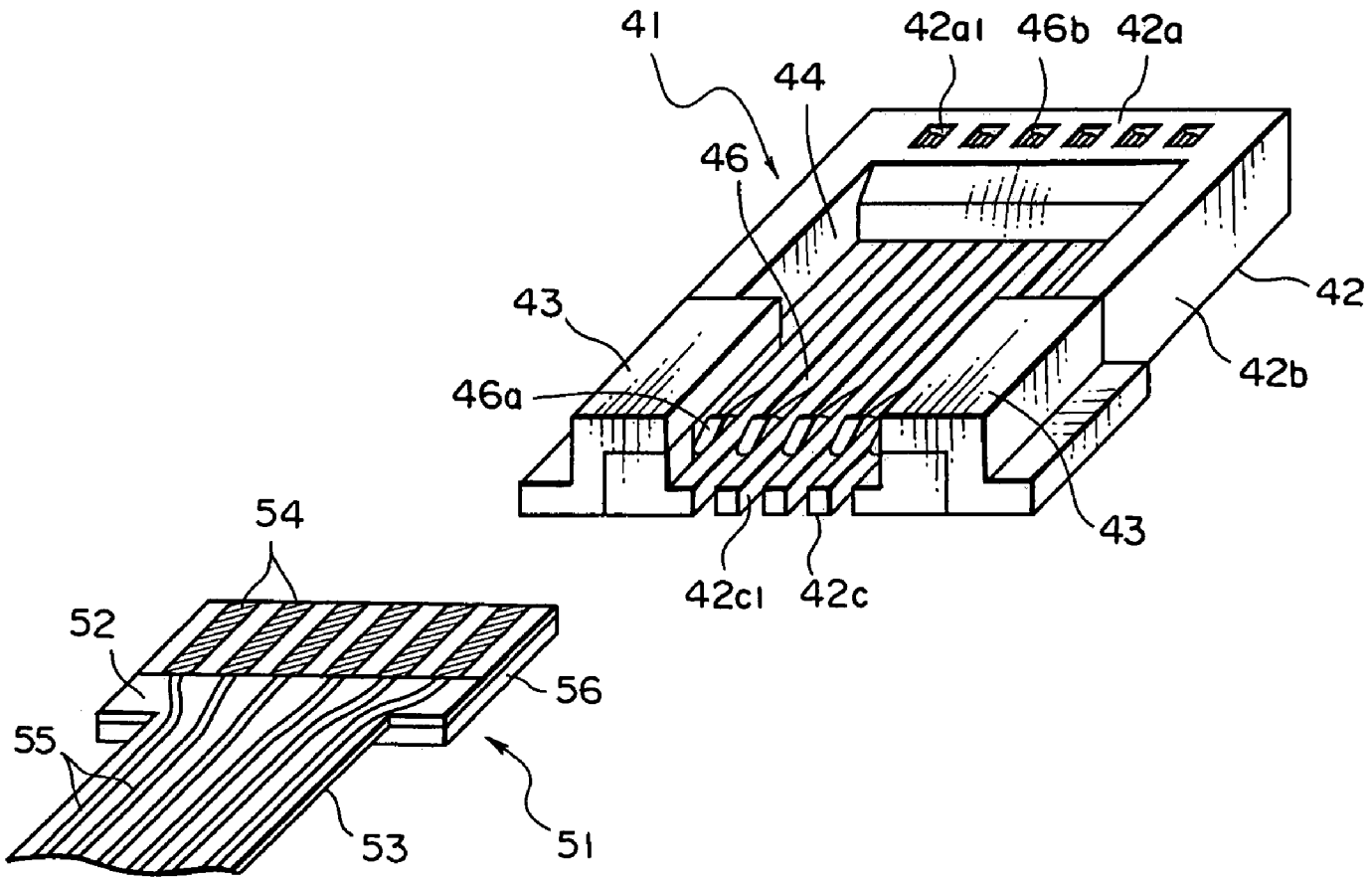
FIG. 1 PRIOR ART
FIG. 1 is a perspective view showing a conventional connector together with a connection object in a disconnected state.
Figure 2:
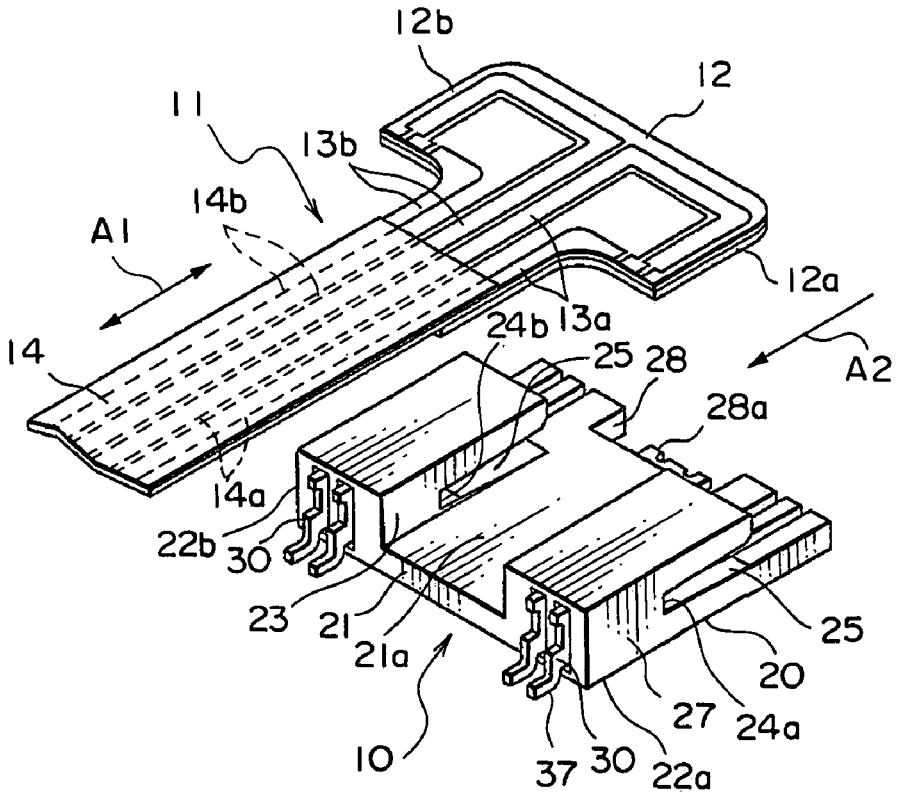
FIG. 2 is a perspective view showing a connector according to an embodiment of the present invention together with a connection object in a disconnected state.
Figure 3:
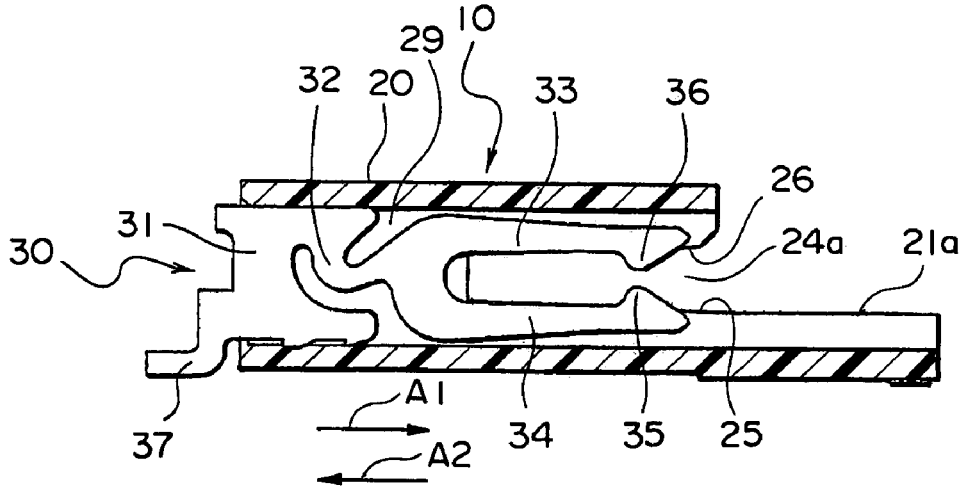
FIG. 3 is a sectional view of the connector illustrated in FIG. 2.

Referring to FIGS. 2 and 3, a connector according to one embodiment of the present invention will be described.

The connector 10 illustrated in FIGS. 2 and 3 serves to connect a flexible board 11 as a connection object. The flexible board 11 comprises a connecting member 12 formed by a generally T-shaped flatplate, a plurality of wiring patterns 13*a* and 13*b* formed on an upper surface of the connecting member 12, a wiring portion 14 connected to the connecting member 12, and a plurality of wiring patterns 14*a* and 14*b* formed on a lower surface of the wiring portion 14. The wiring patterns 13*a* and 13*b* of the connecting member 12 are connected to the wiring patterns 14*a* and 14*b* of the wiring portion 14. The connecting member 12 is provided with first and second protruding portions 12*a* and 12*b* having a flat shape and formed at opposite sides of an end portion thereof.

In the flexible board 11, a combination of the connecting member 12 and the wiring portion 14 may also be referred to as a wiring portion. In this case, the flexible board 11 is equivalent to a combination of the wiring portion (12, 14) and the first and the second protruding portions 12*a* and 12*b* connected to an end portion of the wiring portion in a first direction A1. It is to be noted here that the wiring patterns (13*a*, 13*b*, 14*a*, and 14*b*) extend from the wiring portion to each of the first and the second protruding portions 12*a* and 12*b*.

The connector 10 includes a housing 20 of an insulating plastic material. The housing 20 has a generally rectangular center portion, i.e., a main body portion 21, and first and second side portions 22*a* and 22*b* formed at left and right sides of the main body portion 21 to be integral therewith. The housing 20 is provided with a groove or a recess 23 formed between the first and the second side portions 22*a* and 22*b* to receive the connecting member 12.

The main body portion 21 has an upper surface, i.e., a receiving surface 21*a* as a flat surface. The first and the second side portions 22*a* and 22*b* are provided with first and second receiving grooves 24*a* and 24*b* for receiving the first and the second protruding portions 12*a* and 12*b* of the connecting member 12, respectively. The first receiving groove 24*a* is defined by a reference plane 25 substantially flush with the receiving surface 21*a*, an opposite plane 26 opposite to the reference plane 25 with a space left therebetween, and a wall portion 27 for locking the movement of the first protruding portion 12*a* in a second direction A2 opposite to the first direction A1. The second receiving groove 24*b* has a structure similar to that of the first receiving groove 24*a*. Thus, the housing 20 has a symmetrical structure. It is to be noted that the reference plane 25 and the opposite plane 26 may be slightly inclined to the receiving surface 21*a* and to each other.

The main body portion 21 is provided with a recessed portion 28 formed at its end portion in the first direction A1. In the recessed portion 28, a holddown 28*a* is disposed and attached to the housing 20.

The first side portion 22*a* has two holding holes 29. In the holding holes 29, a pair of contacts 30 formed by a conductive material are inserted and fixedly held. Similarly, the second side portion 22*b* has two holding holes 29. In the holding holes 29, another pair of contacts 30 are inserted and fixedly held. Herein, the holding holes 29 of the first side portion 22*a* will be called first holding holes while the holding holes 29 of the second side portion 22*b* will be called second holding holes. The contacts 30 held by the first holding holes will be called first contacts while the contacts 30 held by the second holding holes will be called second contacts.

Referring to FIG. 3, one of the contacts 30 will be described. The remaining contacts 30 have a similar structure.

The contact 30 has a base portion 31 fixed to the housing 20, a curved portion 32 adjacent to one end of the base portion 31, a pair of beam portions 33 and 34 in a bifurcated or branched shape, a pair of contacting portions 35 and 36 formed at end portions of the beam portions 33 and 34, respectively, and a soldering portion 37 formed at the other end of the base portion 31. Each of the curved portion 32 and the beam portions 33 and 34 is elastically deformable. The contacting portion 35 protrudes over the reference plane 25 into the first receiving groove 24*a* and is therefore called a reference contacting portion. The contacting portion 36 protrudes over the opposite plane 26 into the first receiving groove 24*a* and is therefore called an opposite contacting portion.

Figure 4:
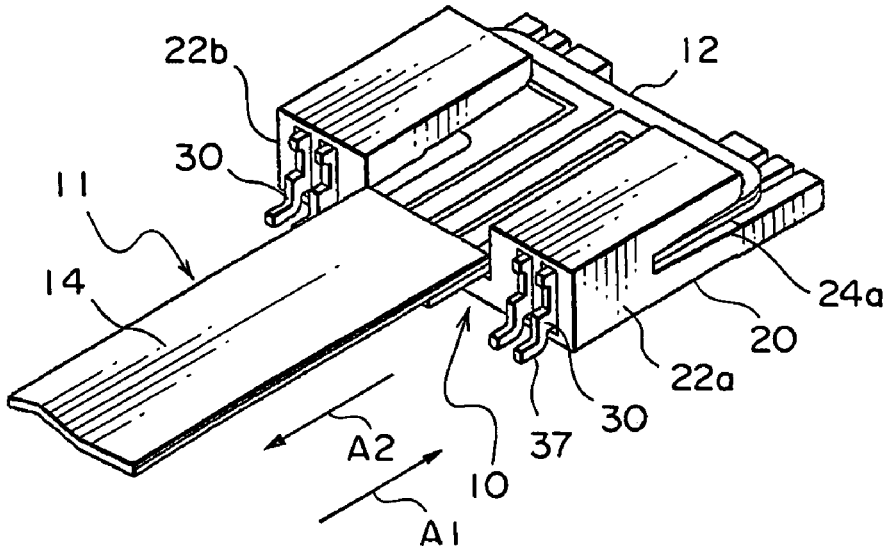
FIG. 4 is a perspective view of the connector illustrated in FIGS. 2 and 3 when the connection object is connected thereto.
Figure 5:
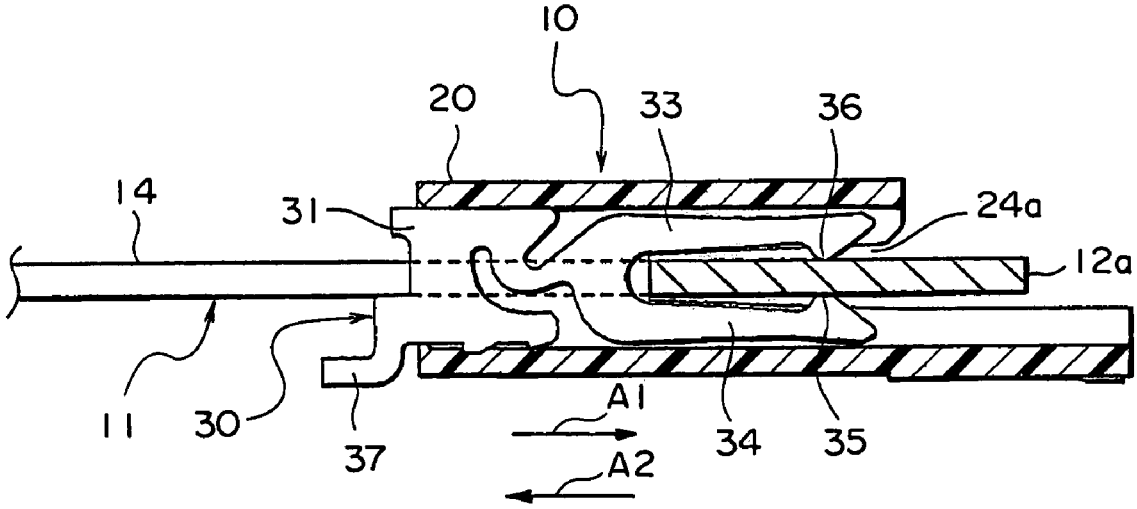
FIG. 5 is a sectional view of the connector illustrated in FIG. 4 with the connection object connected thereto.

Referring to FIGS. 4 and 5 in addition, an operation of connecting the flexible board 11 to the connector 10 will be described.

At first, the wiring portion 14 of the flexible board 11 is placed on the recessed portion 23 of the housing 20. The first and the second protruding portions 12*a* and 12 *b* are faced to the first and the second receiving grooves 24*a* and 24*b*, respectively. Next, the flexible board 11 is moved in the second direction A2 to insert the first and the second protruding portions 12*a* and 12*b* into the first and the second receiving grooves 24*a* and 24*b*, respectively. Then, the contacting portions 35 and 36 of the contacts 30 are elastically press-contacted to opposite surfaces of the first and the second protruding portions 12*a* and 12*b*. As a consequence, the wiring patterns 13*a* and 13*b* formed on the connecting member 12 are electrically connected to the contacting portions 36 of the contacts 30.

The receiving surface 21*a* of the main body portion 21 of the housing 20 has a flat shape and, therefore, can be used as a sucked portion to be sucked to a sucking member of an automatic mounting apparatus. Therefore, an operation of mounting the connector 10 to a mounting object by the use of the automatic mounting apparatus is easy.

Since the housing 20 has no such part that interferes the insertion of the flexible board 11, the connector 10 can easily be reduced in size. Even if the flexible board 11 is pulled in the second direction A2, the flexible board 11 is not released from the connector 10 because the protruding portions 12*a* and 12*b* are inserted into the receiving grooves 24*a* and 24*b* of the housing 20.

Figure 6:
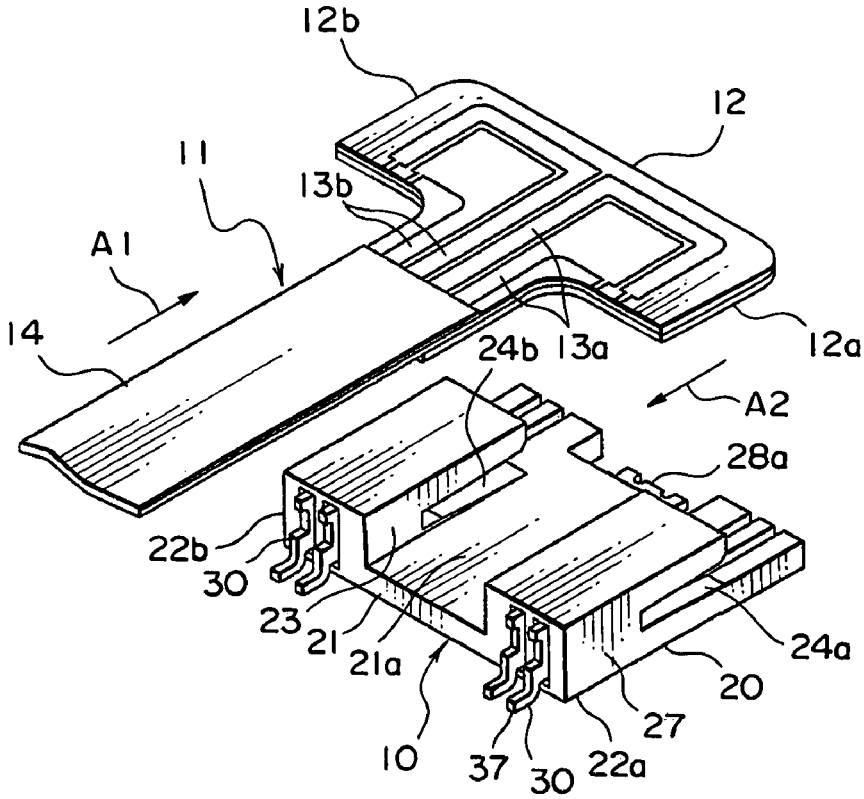
FIG. 6 is a perspective view showing a connector according to another embodiment of the present invention together with a connection object in a disconnected state.
Figure 7:
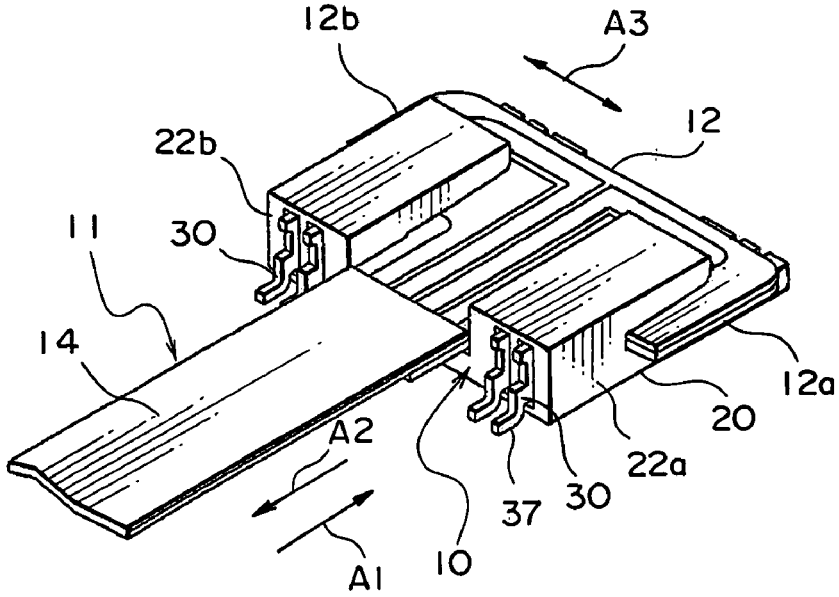
FIG. 7 is a perspective view of the connector illustrated in FIG. 6 when the connection object is connected thereto.
Figure 8:
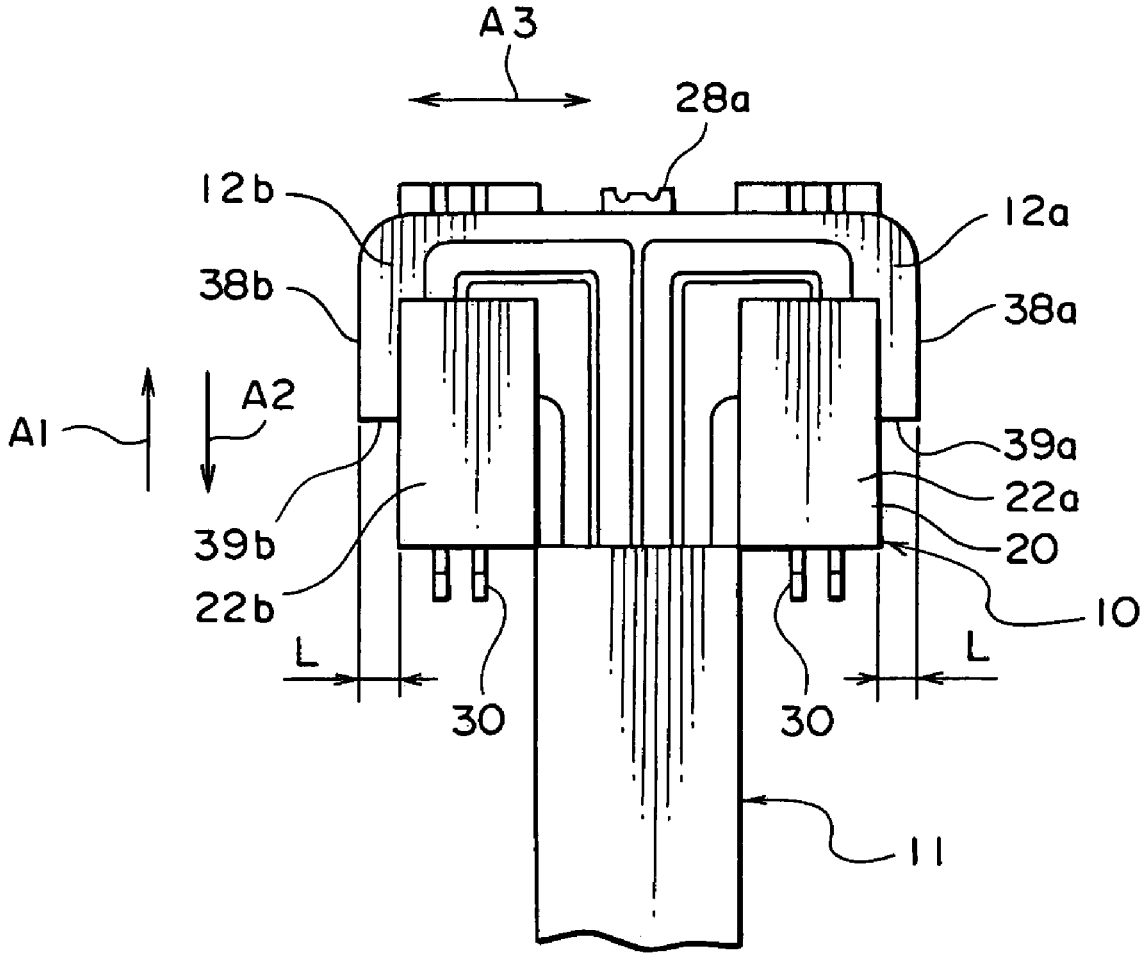
FIG. 8 is a plan view of the connector illustrated in FIG. 6 when the connection object is connected thereto.

Referring to FIGS. 6 through 8, the description will be directed to a connector according to another embodiment of the present invention. Similar parts or portions are designated by the like reference numerals.

In the connector illustrated in FIGS. 6–8, the protruding portions 12*a* and 12*b* have particular portions 38*a* and 38*b* exposed outward from the receiving grooves 24*a* and 24*b*. Each of the particular portions 38*a* and 38*b* protrudes from the housing 20 in a third direction A3 perpendicular to the first and the second directions A1 and A2. In other words, the housing 20 is formed to expose the particular portions 38*a* and 38*b* from the first and the second side portions 22*a* and 22*b* in the third direction A3.

As a consequence, the particular portions 38*a* and 38*b* have engaging portions 39*a* and 39*b*, respectively, each of which has a width represented by L. Namely, the housing 20 has a size smaller than that of the connecting member 12 in the third direction A3.

With this structure, it is readily possible to remove the flexible board 11 from the connector 10 by the use of the particular portions 38*a* and 38*b*. For example, when the engaging portions 39*a* and 39*b* is pushed towards the first direction A1, the flexible board 11 can be moved in the first direction A1 and therefore removed from the connector 10 without causing a buckling of the flexible board 11. In this event, it is unnecessary to form a complicated structure or through holes in the flexible board 11.

While this invention has thus far been described in conjunction with the preferred embodiments thereof, it will be readily possible for those skilled in the art to put this invention into practice in various other manners. For example, the housing may have only one of the side portions. The flexible board may have only one of the protruding portions.

What is claimed is:

1. A connector for connecting a connection object which has a wiring portion, a first protruding portion protruding transversely from said wiring portion on one side thereof, and a wiring pattern extending from said wiring portion to said first protruding portion, said connector comprising:

a housing; and a first contact held in said housing, said housing comprising:

a main body portion provided with a receiving surface for receiving said wiring portion; and a first side portion disposed at one side of said main body portion, said first side portion having a first receiving groove for receiving said first protruding portion, said first contact being held in said first side portion so as to be connected to said wiring pattern of the first protruding portion, said first protruding portion being connected to an end portion of said wiring portion in a first direction, said first side portion having a wall portion which defines an end portion of said first receiving groove and which serves to lock movement of said first protruding portion and positioned in a second direction opposite to said first direction;

wherein said first protruding portion has a particular portion exposed outside of said first receiving groove of said first side portion.

2. The connector according to claim 1, wherein said connection object further has a second protruding portion protruding from said wiring portion on the other side opposite to the one side, said housing further having a second side portion disposed at the other side of said main body portion opposite to the one side, said second side portion having a second receiving groove for receiving said second protruding portion.

3. The connector according to claim 2, further comprising a second contact held by said housing, said connection object having an additional wiring pattern extending from said wiring portion to said second protruding portion, said second contact being held by said second side portion so as to be connected to said wiring pattern of the second protruding portion.

4. The connector according to claim 2, wherein said second protruding portion has a particular portion exposed outside of said second receiving groove.

5. The connector according to claim 1, wherein said first protruding portion has a flat shape, said first receiving groove having a reference plane substantially flush with said receiving surface and an opposite plane faced to said reference plane with a space left therebetween.

6. The connector according to claim 5, wherein said first contact has a reference contacting portion protruding over said reference plane into said first receiving groove.

7. The connector according to claim 6, wherein said first contact has an opposite contacting portion protruding over said opposite plane into said first receiving groove.

8. The connector according to claim 7, wherein at least one of said reference contacting portion and said opposite contacting portion is elastically press-contacted with said first protruding portion.

9. The connector according to claim 1, wherein said first side portion has a first holding hole, said first contact being inserted and held in said first holding hole.

10. The connector according to claim 9, wherein said first contact has a soldering portion exposed from said first holding hole.

11. The connector according to claim 1, wherein said housing is formed to expose a part of said first protruding portion from said first side portion.

12. The connector according to claim 1, wherein said receiving surface is a flat surface.

13. A connector for connecting a connection object which has a wiring portion, a first protruding portion protruding transversely from said wiring portion on one side thereof, and a wiring pattern extending from said wiring portion to said first protruding portion, said connector comprising:

a housing; and a first contact held and positioned in said housing, said housing comprising:

a main body portion provided with a receiving surface for receiving said wiring portion; and a first side portion disposed at one side of said main body portion, said first side portion having a first receiving groove for receiving said first protruding portion, said first contact being held and positioned in said first side portion so as to be connected to said wiring pattern of the first protruding portion, said first protruding portion having a flat shape, said first receiving groove having a reference plane substantially flush with said receiving surface and an opposite plane faced to said reference plane with a space left therebetween, said first contact having a reference contacting portion protruding over said reference plane into said first receiving groove;

wherein said first protruding portion has a particular portion exposed outside of said first receiving groove of said first side portion.

14. The connector according to claim 13, wherein said connection object further has a second protruding portion protruding from said wiring portion on the other side opposite to the one side, said housing further having a second side portion disposed at the other side of said main body portion opposite to the one side, said second side portion having a second receiving groove for receiving said second protruding portion.

15. The connector according to claim 14, further comprising a second contact held by said housing, said connection object having an additional wiring pattern extending from said wiring portion to said second protruding portion, said second contact being held by said second side portion so as to be connected to said wiring pattern of the second protruding portion.

16. The connector according to claim 14, wherein said second protruding portion has a particular portion exposed outside of said second receiving groove.

17. The connector according to claim 13, wherein said first contact has an opposite contacting portion protruding over said opposite plane into said first receiving groove.

18. The connector according to claim 17, wherein at least one of said reference contacting portion and said opposite contacting portion is elastically press-contacted with said first protruding portion.

19. The connector according to claim 13, wherein said first side portion has a first holding hole, said first contact being inserted and held in said first holding hole.

20. The connector according to claim 19, wherein said first contact has a soldering portion exposed from said first holding hole.

21. The connector according to claim 13 wherein said housing is formed to expose a part of said first protruding portion from said first side portion.

22. The connector according to claim 13, wherein said receiving surface is a flat surface.

23. A connector for connecting a connection object which has a wiring portion, a first protruding portion protruding transversely from said wiring portion on one side thereof, and a wiring pattern extending from said wiring portion to said first protruding portion, said connector comprising:

a housing; and a first contact held in said housing, said housing comprising:

a main body portion provided with a receiving surface for receiving said wiring portion; and a first side portion disposed at one side of said main body portion, said first side portion having a first receiving groove for receiving said first protruding portion, said first contact being held and positioned in said first side portion so as to be connected to said wiring pattern of the first protruding portion, said first side portion having a first holding hole, said first contact being inserted and held in said first holding hole, said first contact having a soldering portion exposed from said first holding hole;

wherein said first protruding portion has a particular portion exposed outside of said first receiving groove of said first side portion.

24. The connector according to claim 23, wherein said connection object further has a second protruding portion protruding from said wiring portion on the other side opposite to the one side, said housing further having a second side portion disposed at the other side of said main body portion opposite to the one side, said second side portion having a second receiving groove for receiving said second protruding portion.

25. The connector according to claim 24, further comprising a second contact held by said housing, said connection object having an additional wiring pattern extending from said wiring portion to said second protruding portion, said second contact being held by said second side portion so as to be connected to said wiring pattern of the second protruding portion.

26. The connector according to claim 24, wherein said second protruding portion has a particular portion exposed outside of said second receiving groove.

27. The connector according to claim 23, wherein said first protruding portion has a flat shape, said first receiving groove having a reference plane substantially flush with said receiving surface and an opposite plane faced to said reference plane with a space left therebetween.

28. The connector according to claim 23, wherein said housing is formed to expose a part of said first protruding portion from said first side portion.

29. The connector according to claim 23, wherein said receiving surface is a flat surface.

* * * * *